US009457231B2

(12) United States Patent
Rodgers, Jr.

(10) Patent No.: US 9,457,231 B2
(45) Date of Patent: Oct. 4, 2016

(54) SWIM FIN ASSEMBLY

(71) Applicant: Michael Dudley Rodgers, Jr., Oceanside, CA (US)

(72) Inventor: Michael Dudley Rodgers, Jr., Oceanside, CA (US)

( * ) Notice: Subject to any disclaimer, the term of this patent is extended or adjusted under 35 U.S.C. 154(b) by 0 days.

(21) Appl. No.: 15/081,617

(22) Filed: Mar. 25, 2016

(65) Prior Publication Data

US 2016/0206925 A1 Jul. 21, 2016

Related U.S. Application Data

(63) Continuation of application No. 14/628,139, filed on Feb. 20, 2015, now abandoned.

(60) Provisional application No. 61/950,837, filed on Mar. 11, 2014.

(51) Int. Cl.
*A63B 31/11* (2006.01)

(52) U.S. Cl.
CPC ..... *A63B 31/11* (2013.01); *A63B 2031/112* (2013.01)

(58) Field of Classification Search
CPC ..... A63B 31/11
USPC ..... 441/63, 64
See application file for complete search history.

(56) References Cited

U.S. PATENT DOCUMENTS 3,268,927 A * 8/1966 Markowitz ..... A63B 31/12 36/114
5,151,060 A 9/1992 Lam
5,632,662 A * 5/1997 Cadorette ..... A63B 31/11 441/63
5,645,460 A * 7/1997 Johnson ..... A63B 31/11 441/61
6,126,502 A * 10/2000 Hull ..... A63B 31/11 441/63
6,540,574 B2 * 4/2003 Hashizume ..... A63B 31/11 441/64
6,672,920 B2 * 1/2004 Wilson ..... A63B 31/11 441/64
6,702,633 B1 * 3/2004 Johnson ..... A63B 31/11 441/64
7,069,670 B1 * 7/2006 Gerke ..... A41D 17/00 2/22
7,140,937 B2 * 11/2006 Cadorette ..... A43B 5/08 441/64
8,087,959 B2 * 1/2012 Hsu ..... A63B 31/11 24/614
8,246,404 B1 * 8/2012 Sweet ..... A63B 31/11 441/60
8,641,464 B2 * 2/2014 Ortwig ..... A63B 31/12 441/64
8,678,870 B2 * 3/2014 Johnson ..... A63B 31/12 441/60
2005/0221698 A1 * 10/2005 Sclafani ..... A63B 31/11 441/64
2010/0075554 A1 * 3/2010 Johnson ..... A63B 31/11 441/64
2011/0014830 A1 * 1/2011 Lan ..... A63B 31/11 441/64
2011/0104968 A1 * 5/2011 Johnson ..... A63B 31/12 441/60
2012/0252289 A1 * 10/2012 Johnson ..... A63B 31/12 441/60

* cited by examiner

*Primary Examiner* — Lars A Olson
*Assistant Examiner* — Jovon Hayes
(74) *Attorney, Agent, or Firm* — Plager Schack LLP

(57) ABSTRACT

A swim fin assembly is configured to allow changing a swim fin and reduce leg strain of a human user. The swim fin assembly includes a leg portion, attached to a foot portion, and configured to accommodate a human leg and foot of the human user. A rear support is attached to the leg portion and further attached to a rear bracket. A fin attachment bracket is connected to the rear bracket. Inserting the swim fin into the fin attachment bracket enables a user to swim with reduced leg strain.

6 Claims, 3 Drawing Sheets

SWIM FIN ASSEMBLY

RELATED APPLICATIONS

This application is a continuation-in-part of non-provisional patent application U.S. Ser. No. 14/628,139 filed on Feb. 20, 2015, which in turn, claims priority to provisional patent application U.S. Ser. No. 61/950,837 filed on Mar. 11, 2014, the entire contents of both applications is herein incorporated by reference.

BACKGROUND

The embodiments herein relate generally to athletic equipment.

Prior to embodiments of the disclosed invention, users could not use different swim fins which prevented finding the optimal swim fin or being able to take advantage of advances in swim fin technology (by trying new more advanced swim fins) or require the user to have two sets of fins in the event the user did not wish to use an embodiment of the swim fin assembly, and leg and muscle strain were problems for a swimmer. Some endeavors in this field include: U.S. Pat. No. 6,702,633 issued to Johnson; U.S. Pat. No. 6,126,502 issued to Hull; and U.S. Pat. No. 5,151,060 issued to Lam.

Johnson and Lam both teach a swim fin assembly having a fin attached to one of two points on a shoe worn around the foot and ankle of a human user. Neither teaches a brace that covers a portion of a human user's calf. Hull teaches a diving fin with a brace that is configured to wrap around a user's calf. The brace is attached to a lockably engagable blade that acts as the fin. However, there is not a locking hinge that can hold a fin. Embodiments of the disclosed invention solve this problem.

SUMMARY

A swim fin assembly is configured to allow changing a swim fin and reduce leg strain of a human user. The swim fin assembly includes a leg portion, attached to a foot portion, and configured to accommodate a human leg and foot of the human user. A rear support is attached to the leg portion and further attached to a rear bracket. A fin attachment bracket is connected to the rear bracket. Inserting the swim fin into the fin attachment bracket enables a user to swim with reduced leg strain.

In some embodiments a slider bracket can be attached to the rear bracket. A leg attachment portion can be connected to the slider bracket. A leg attachment strap can be connected to the leg attachment portion and configured to wrap around the leg of a human user.

In some embodiments, a fin attachment bracket lock can be connected to the rear bracket and configured to hold the fin attachment bracket below the foot portion. In some embodiments, the fin attachment bracket can include a first downward segment, attached to a first connection segment and a forward segment. A second connection segment can be attached to the forward segment. A second downward segment can be attached to the forward segment and a third connection segment. A fin attachment grip can be wrapped around third connection segment. The fin attachment grip can be configured to hold the swim fin.

In some embodiments, the slide bracket can further comprise a first tube, a second tube, and a grip portion. In some embodiments, the leg attachment portion can further comprises a leg attachment bracket. A first rod, a second rod and a leg attachment strap can be attached to the leg attachment bracket.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
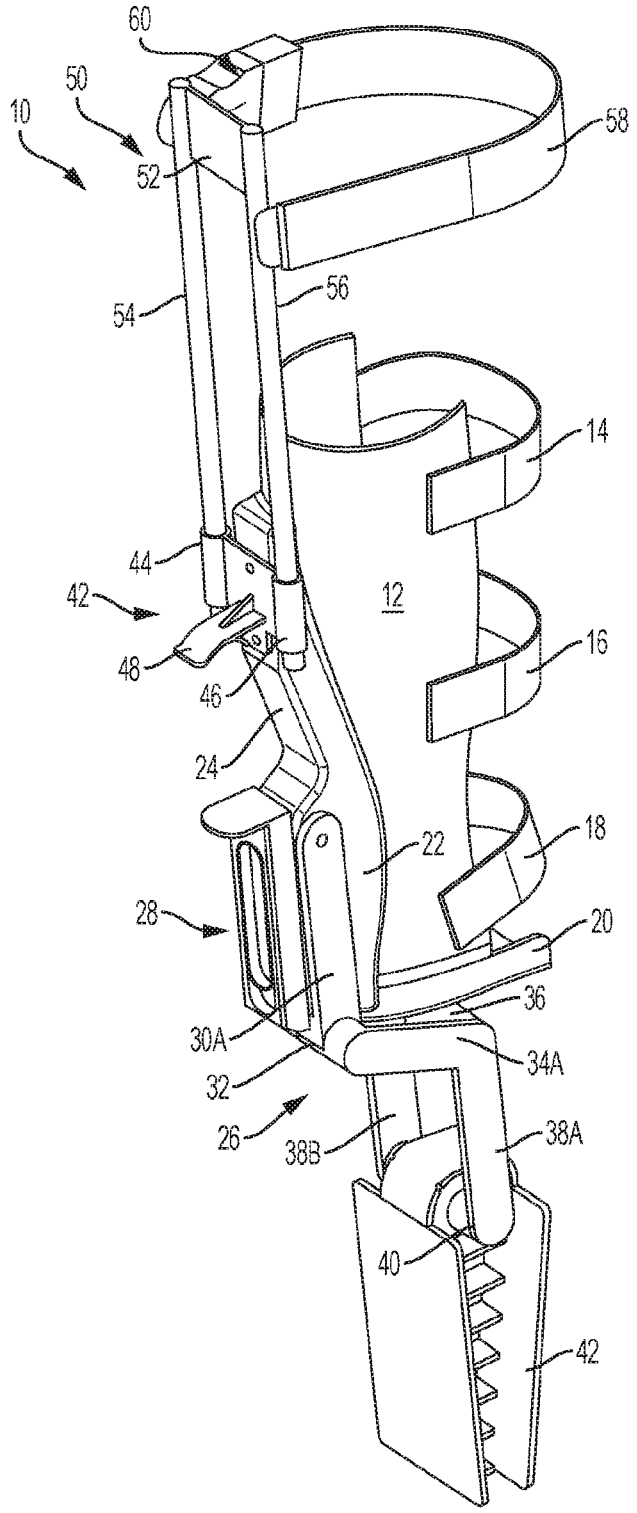
FIG. 1 shows a perspective view of one embodiment of the present invention.

By way of example, and referring to FIG. 1, swim fin assembly 10 further comprises leg portion 12 which is attached to upper strap 14, middle strap 16 and lower strap 18. Leg portion 12 is attached to foot support 20 and rear support 22.

Rear support 22 is attached to rear bracket 24. Rear bracket 24 is rotatably coupled to fin attachment bracket 26 and fin attachment bracket lock 28. Fin attachment bracket 26 further comprises first downward segment 30A, 30B which is attached to first connection segment 32 and forward segment 34A, 34B. Forward segment 34A, 34B is further attached to second connection segment 36 and second downward segments 38A, 38B. Second downward segments 38A, 38B are further attached to third connection segment 40. Fin attachment grip 42 is wrapped around third connection segment 40.

Rear bracket 24 is further attached to slider bracket 42. Slider bracket 42 further comprises first tube 44, second tube 46 and grip portion 48. Leg attachment portion 50 further comprises leg attachment bracket 52. Leg attachment bracket 52 is attached to first rod 54, second rod 56 and leg attachment strap 58. Leg attachment strap can further comprise clip 60.

Figure 2:
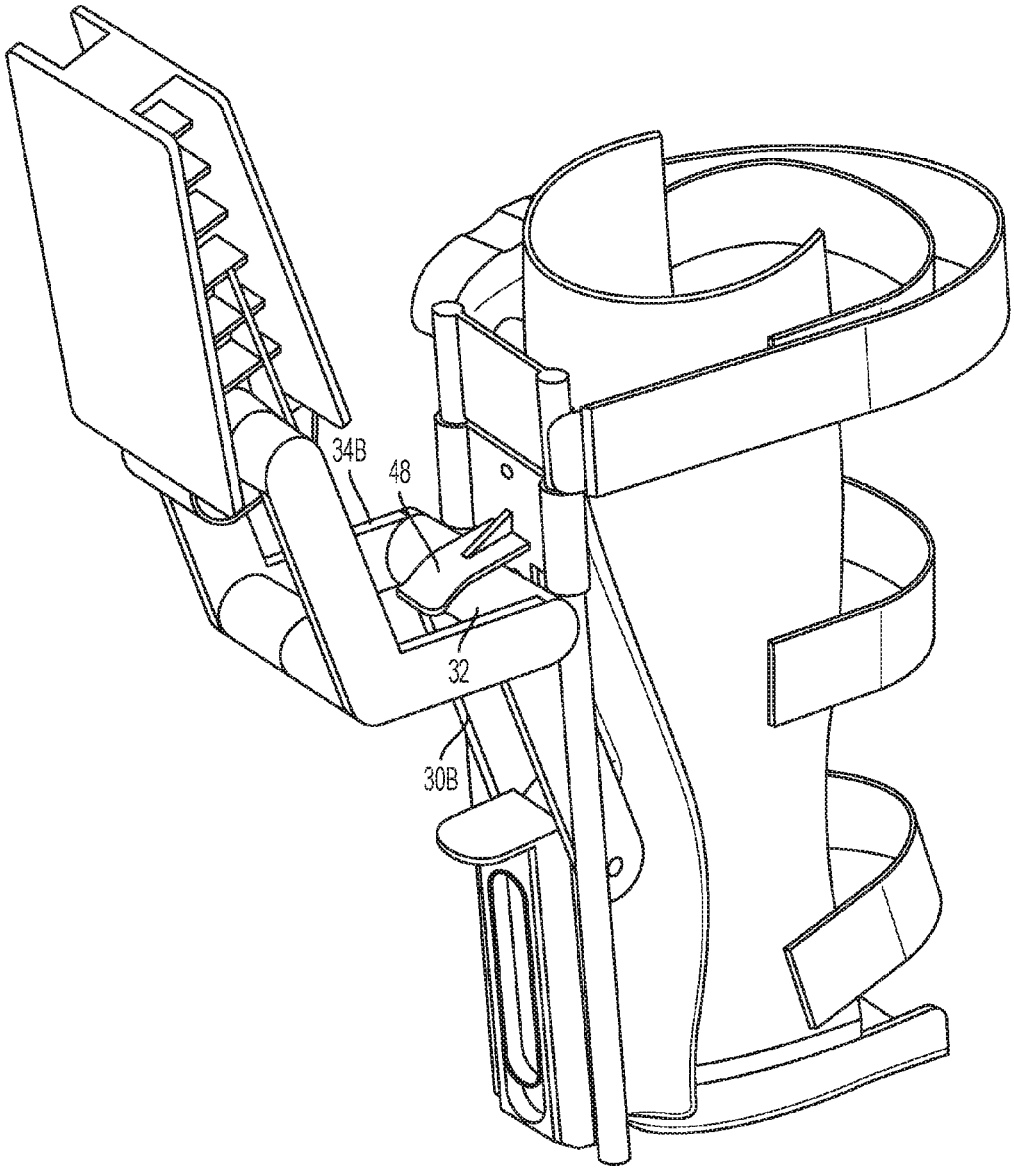
FIG. 2 shows a perspective view of one embodiment of the present invention.

FIG. 2 shows a first mode of operation. When fin attachment bracket lock 28 is released, first connection segment 32 can be folded upward and beneath grip portion 48. Further leg attachment portion 50 can be descended with first rod 54 sliding down first tube 44 and second rod 56 sliding down second tube 46 until slider bracket 42 contacts leg attachment bracket 52.

FIG. 1 shows a second mode of operation. When fin attachment bracket lock 28 is locked in front of first connection segment 32, then third connection segment 40 extends below foot support 20. Further, leg attachment portion 50 can be ascended with first rod 54 sliding up first tube 44 and second rod 56 sliding up second tube 46 until a human user would be comfortable with the position of leg attachment strap 58. In the second mode of operation, when first rod 54 and second rod 56 are extended, leg attachment strap 58 can be wrapped around the thigh or upper leg above the knee of the human user to hold the entire leg in a straight position in relation to the lower leg.

Figure 3:
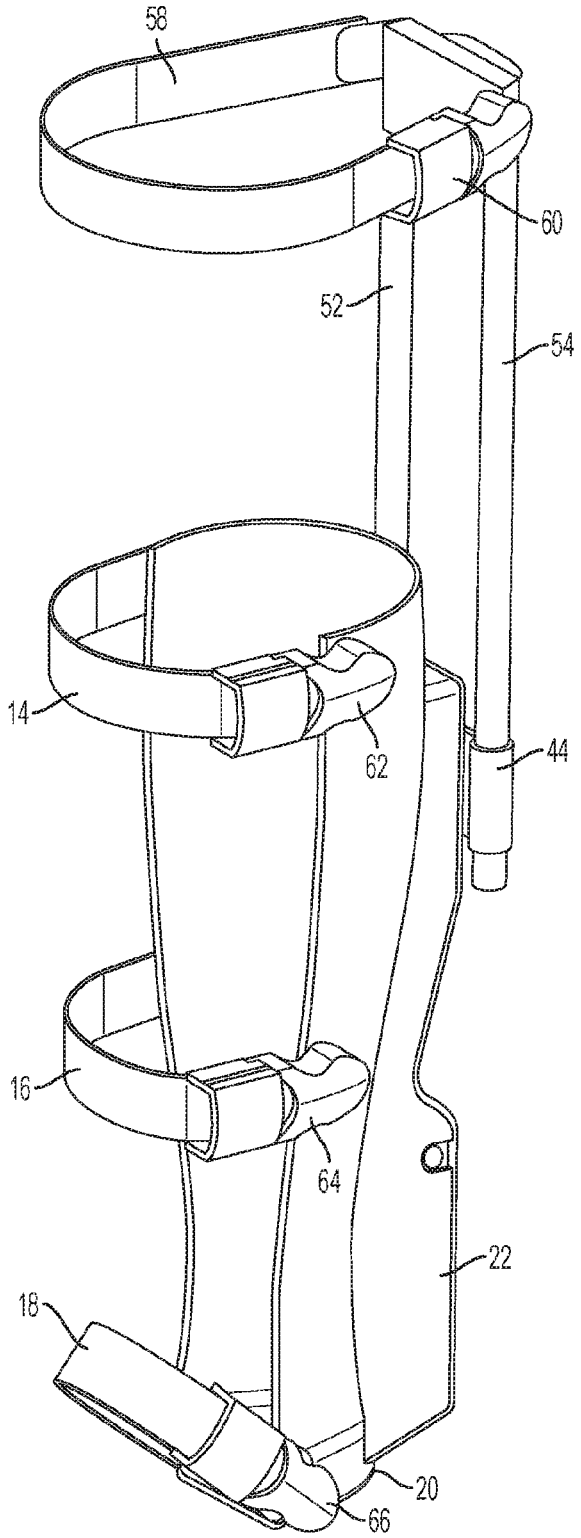
FIG. 3 shows a perspective view of one embodiment of the present invention.

Turning to FIG. 3, upper strap 14 can be held in place and tightened with upper strap fastener 62. Middle strap 16 can be held in place and tightened with middle strap fastener 64. Lower strap 18 can be held in place and tightened with lower strap fastener 66.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A swim fin assembly, configured to allow changing a swim fin and reduce leg strain of a human user; the swim fin assembly comprising:

a leg portion, attached to a foot portion, configured to accommodate a human leg and foot of the human user;

a rear support, attached to the leg portion and further attached to a rear bracket;

a fin attachment bracket, connected to the rear bracket;

wherein inserting the swim fin into the fin attachment bracket enables a user to swim with reduced leg strain.

2. The swim fin assembly, of claim 1, further comprising:

a slider bracket, attached to the rear bracket;

a leg attachment portion, connected to the slider bracket, a leg attachment strap, connected to the leg attachment portion and configured to wrap around the leg of a human user.

3. The swim fin assembly, of claim 2, further comprising:

a fin attachment bracket lock, connected to the rear bracket and configured to hold the fin attachment bracket below the foot portion.

4. The swim fin assembly, of claim 3, wherein the fin attachment bracket further comprises:

a first downward segment, attached to a first connection segment and a forward segment;

a second connection segment, attached to the forward segment a second downward segment, attached to the forward segment and a third connection segment;

a fin attachment grip, wrapped around third connection segment wherein the fin attachment grip is configured to hold the swim fin.

5. The swim fin assembly, of claim 4, wherein the slide bracket further comprises: a first tube, a second tube, and a grip portion.

6. The swim fin assembly, of claim 4, wherein the leg attachment portion further comprises a leg attachment bracket;

a first rod, a second rod and a leg attachment strap, attached to the leg attachment bracket.

* * * * *